US006688003B2

(12) United States Patent
Scarla

(10) Patent No.: US 6,688,003 B2
(45) **Date of Patent: *Feb. 10, 2004**

(54) UTILITY KNIFE

(76) Inventor: Robert E. Scarla, 7498 E. Monte Cristo Ave., Suite No. 102, Scottsdale, AZ (US) 85260

( * ) Notice: Subject to any disclaimer, the term of this patent is extended or adjusted under 35 U.S.C. 154(b) by 0 days.

This patent is subject to a terminal disclaimer.

(21) Appl. No.: 10/053,719

(22) Filed: Jan. 22, 2002

(65) Prior Publication Data

US 2003/0136004 A1 Jul. 24, 2003

Related U.S. Application Data

(63) Continuation-in-part of application No. 09/676,132, filed on Sep. 29, 2000, now Pat. No. 6,354,007.

(51) Int. Cl.[7] ..... B26B 1/02
(52) U.S. Cl. ..... 30/156; 30/330
(58) Field of Search ..... 30/153, 155, 156, 30/157, 158, 159, 160, 161, 329, 330, 339, 344

(56) References Cited

U.S. PATENT DOCUMENTS

| | | | | | |
|---|---|---|---|---|---|
| 493,075 | A | | 3/1893 | Evertz | |
| 515,045 | A | | 2/1894 | Von Bultzingslowen | |
| 1,444,324 | A | | 2/1923 | Brooks | |
| 1,706,251 | A | | 3/1929 | Perry | |
| 2,134,973 | A | * | 11/1938 | Harwell | |
| 2,265,775 | A | | 12/1941 | McNamara | |
| 2,284,128 | A | | 5/1942 | Bush | |
| 2,523,575 | A | | 9/1950 | Kassel | |
| 2,914,850 | A | | 12/1959 | Kuhnl | |
| 3,306,297 | A | | 2/1967 | Voorhees et al. | |
| 3,845,554 | A | * | 11/1974 | Joanis et al. | 30/339 |
| 4,017,969 | A | * | 4/1977 | Stonebraker | 30/156 |
| 4,261,104 | A | | 4/1981 | Cuscovitch | |
| 4,347,665 | A | * | 9/1982 | Glesser | 30/161 |
| 4,408,396 | A | * | 10/1983 | Scholl | 30/339 |
| 4,575,940 | A | * | 3/1986 | Wenzel | 30/339 |
| 4,604,805 | A | | 8/1986 | Krieger | |
| 4,620,369 | A | * | 11/1986 | Gercken | 30/329 |
| 4,936,014 | A | * | 6/1990 | Shaanan et al. | 30/162 |
| 5,095,624 | A | | 3/1992 | Ennis | |
| 5,303,469 | A | * | 4/1994 | Yin-Han | 30/329 |
| 5,909,930 | A | | 6/1999 | Ragland, III et al. | |
| 5,966,816 | A | | 10/1999 | Roberson | |
| 6,026,575 | A | * | 2/2000 | Wonderley | 30/330 |
| 6,354,007 | B1 | * | 3/2002 | Scarla | 30/156 |

* cited by examiner

*Primary Examiner*—Hwei-Siu Payer
(74) *Attorney, Agent, or Firm*—Snell & Wilmer, L.L.P.

(57) ABSTRACT

A utility knife include a handle, a neck pivotally mounted on the handle, and a blade mounted in the neck. The neck can be folded into the handle to transport the utility knife. The blade is slidably removably inserted into and from the handle without requiring disassembly of the handle.

9 Claims, 5 Drawing Sheets

FIG. 6
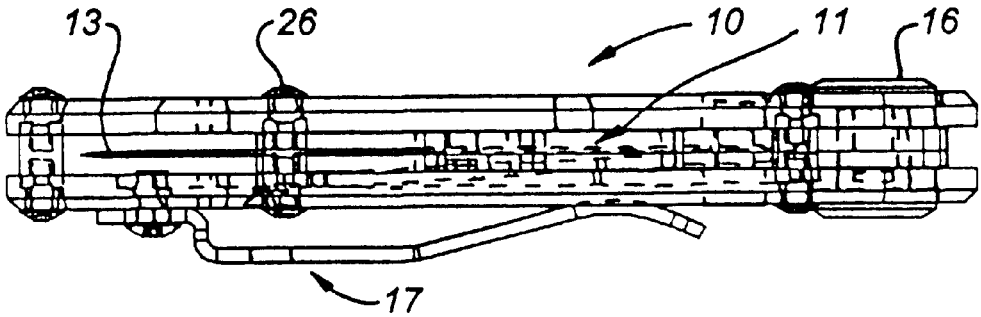
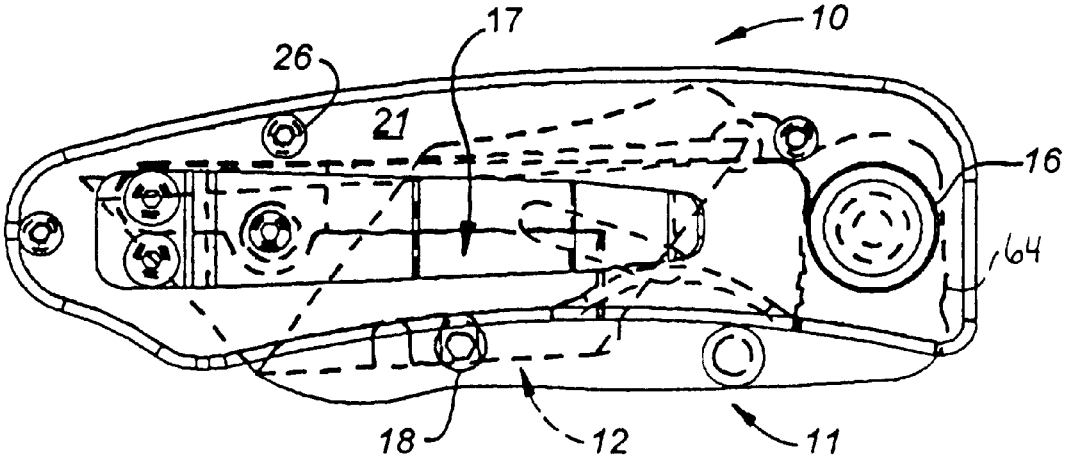
FIG. 7

UTILITY KNIFE

CROSS REFERENCE TO RELATED APPLICATIONS

This application is a continuation-in-part of application Ser. No. 09/676,132 filed on Sep. 29, 2000 now U.S. Pat. No. 6,354,007.

This invention pertains to a utility knife.

More particularly, this invention pertains to a utility knife which utilizes a cutting blade having a trapezoidal shape.

In a further respect, this invention pertains to a method and apparatus which facilitates the safe transport and operation of a utility knife.

Conventional utility knives are well known and include an elongate, typically gray colored handle which is approximately six inches long. A blade is mounted in the knife handle. The blade has a trapezoidal shape. The blade is pushed through a slot formed in the front of the handle. The blade moves between a first stored operative position inside the handle and a second deployed operative position with a portion of the blade outside the handle. A button on the top of the knife handle is slidably pushed along a slot formed in the top of the handle. When the button is pushed to one end of the slot, the trapezoidal blade is in the first stored operative position. When the button is pushed to the other end of the slot, the trapezoidal blade is in the second deployed operative position. When the blade is in the second deployed operative position, the utility knife can be used to cut desired objects with the blade.

One disadvantage of a conventional utility knife is that with use the button becomes loose and the blade can unintentionally slide from its first stored operative position to its second deployed operative position. This can be dangerous, especially when the utility knife is in a person's pocket. Another disadvantage of a conventional utility knife is that the length of the handle makes is awkward to carry the knife in a pants pocket. A further disadvantage of a conventional utility knife is that the entire handle of the knife ordinarily must be disassembled in order to insert a new blade in the utility knife.

Accordingly, it would be highly desirable to provide an improved utility knife and method for using the same which would facilitate the safe transport and use of the knife.

Therefore, it is a principal object of the instant invention to provide an improved utility knife.

A further object of the invention is to provide an improved apparatus and method for using a utility knife which includes a blade having a trapezoidal shape.

Another object of the invention is to provide an improved method and apparatus for securing and removing a trapezoidal blade from a utility knife.

Still a further object of the invention is to provide an improved method and apparatus for utilizing a utility knife which significantly reduces the risk that the utility knife blade can inadvertently slide free and injure a user.

The foregoing and other, further and more specific objects and advantages of the invention will be apparent from the following detailed description of the invention, taken in conjunction with the drawings, in which:

FIG. 6 is a duplication of the depiction of the utility knife of FIG. 2 with dashed lines incorporated to further illustrate construction details of the invention;

FIG. 7 is a duplication of the depiction of the utility knife of FIG. 3 with dashed lines incorporated to further illustrate construction details thereof;

Figure 1:
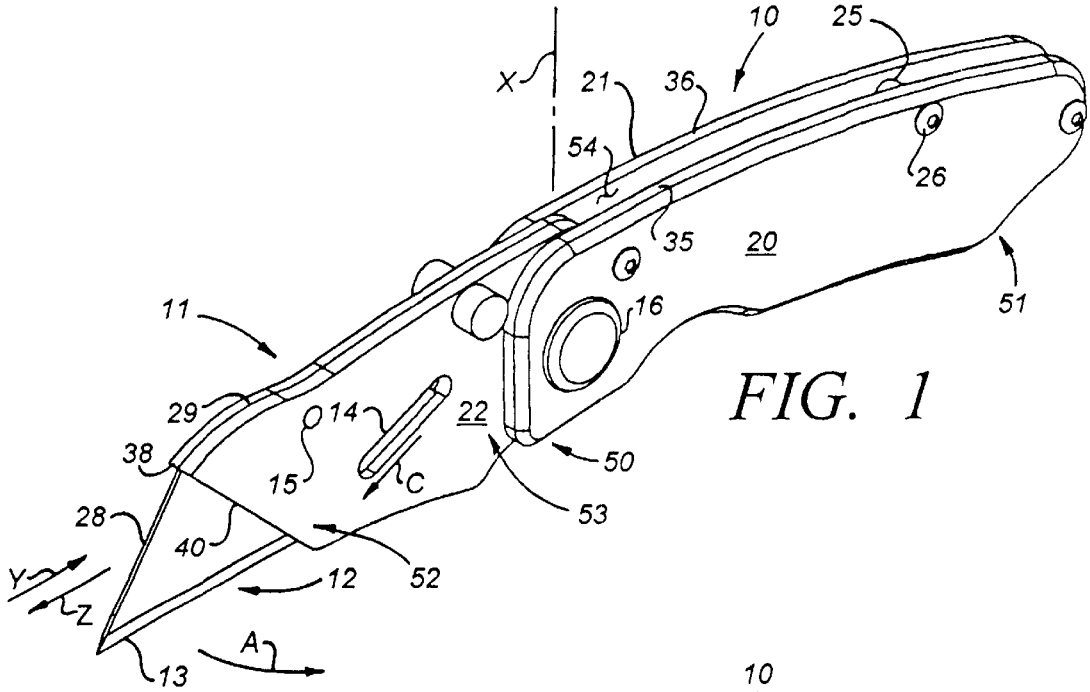
FIG. 1 is perspective view illustrating a utility knife constructed in accordance with the principles of the invention.

Briefly, in accordance with the invention, I provide an improved utility knife. The utility knife includes a handle having a first end, a second end, and an elongate groove; a neck having a distal end and having a proximate end; and, a trapezoidal blade mounted on the distal end. The blade includes a base; an upper edge opposed to and spaced apart from the base; a cutting edge extending along the base; and, an anchor opening formed through the blade. About half of the cutting edge extends into the distal end and about half of the cutting edge extends outwardly from the distal end of the neck. The utility knife also includes a system for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes apparatus extending through the neck and the anchor opening to secure the blade in the neck.

In a further embodiment of the invention, I provide an improved utility knife. The utility knife includes a handle having a first end, a second end, and an elongate groove; a neck having a distal end, a proximate end, and an opening; an aperture formed in the distal end of the neck; and, a trapezoidal blade slidably inserted in the aperture. The blade includes a base; an upper edge opposed to and spaced apart from the base; a cutting edge extending along the base; and, an anchor opening formed through the blade. The blade is moveable between two operative positions with respect to the aperture, a first operative position with the blade slidably removed from the aperture, and a second inserted operative position with the blade slidably inserted in the aperture such that the anchor opening is in registration with the opening in the neck. The utility knife also includes apparatus for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes apparatus extending through the opening in the neck and the anchor opening when the blade is in the second inserted operative position to secure the blade in the neck.

In another embodiment of the invention, I provide an improved utility knife. The knife includes a handle having a first end, a second end, and an elongate groove; a neck having a distal end, a proximate end, and an aperture formed in the distal end of the neck; and, a trapezoidal blade slidably inserted in the aperture and including a base, an upper edge opposed to and spaced apart from the base, a cutting edge extending along the base, and an anchor opening formed through the blade. The blade is moveable between two operative positions with respect to the aperture, a first operative position with the blade slidably removed from the aperture, and a second inserted operative position with the blade slidably inserted in the aperture. The utility knife also includes apparatus for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes apparatus extending through the anchor opening when the blade is in the second inserted operative position to secure said blade in the neck. The utility knife also includes a slot formed in the neck for removing the blade from the aperture.

In still a further embodiment of the invention, I provide a utility knife including a handle having a first end, a second end, and an elongate groove; a neck having a distal end and a proximate end; a trapezoidal blade mounted on the distal end and including a base, an upper edge opposed to and spaced apart from the base, a cutting edge extending along the base, and an anchor opening formed through the blade. The utility knife also includes apparatus for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes securing apparatus extending through the neck and the anchor opening to secure the blade in the neck. The blade, neck, and securing apparatus are shaped and dimensioned such that when the neck is in either of the first and second operative positions, the securing apparatus is inside of the handle.

In yet another embodiment of the invention, I provide an improved method of utilizing a utility knife. The utility knife includes a handle; a neck; and a trapezoidal blade mounted in the handle. The improved method includes the steps of pivotally attaching the neck to the handle such that the neck can be folded between an open and a closed position; pivoting the neck to a closed position; transporting the utility knife to a work location; and, pivoting the neck to an open position.

In a further embodiment of the invention, I provide an improved utility knife. The knife includes a handle having a first end and a second end; a neck having a distal end and having a proximate end; and, a trapezoidal blade mounted on the distal end. The blade includes a base; an upper edge opposed to and spaced apart from the base, and a cutting edge extending along at least a portion of the base. A portion of the blade extends into the distal end and another portion of the blade extends outwardly from the distal end of the neck. The utility knife also includes apparatus for pivotally attaching the proximate end to the first end such that the neck can be moved between two positions, a first open unfolded position with the cutting edge exposed for use to cut an object, and a second closed folded position with the cutting edge positioned adjacent the handle. The knife also includes an anchor apparatus to releasably secure the blade in the neck.

In another embodiment of the invention, I provide an improved utility knife. The knife includes a handle having a first end and a second end; a neck having a distal end; a proximate end; and, a longitudinal axis; an aperture formed in the distal end of the neck; and, a trapezoidal blade slidably inserted in the aperture. The blade includes a base; an upper edge opposed to and spaced apart from the base; and, at least one cutting edge on at least a portion of the base. The blade is moveable between two positions with respect to the aperture, a first position with the blade slidably removed from the aperture, and a second inserted position with a portion of the blade slidably inserted in the aperture and with the blade generally parallel to the longitudinal axis. The knife also includes apparatus for attaching the proximate end to the first end; and, apparatus for releasably securing the blade in the second position in the aperture.

In still a further embodiment of the invention, I provide an improved utility knife. The knife includes a handle having a first end and a second end; a neck having a distal end, a proximate end, a top, and a bottom; and, a trapezoidal blade mounted on the distal end. The blade includes a base; an upper edge opposed to and spaced apart from the base, and, at least one cutting edge extending along at least a portion of the base. A portion of the blade extends into the distal end of the neck and another portion of the blade extends outwardly from the distal end of the neck. The utility knife also includes apparatus for pivotally attaching the proximate end to the first end such that the neck can be moved between two positions, a first open unfolded position with the cutting edge exposed for use to cut an object, and a second closed folded position with the cutting edge positioned adjacent the handle. The utility knife also includes anchor apparatus to releasably secure the blade in the neck; and, a finger stop on the bottom adjacent the blade.

In still another embodiment of the invention, I provide an improved utility knife. The utility knife includes a handle having a first end, a second end, and a clip; a neck having a distal end and having a proximate end; and, a trapezoidal blade mounted on the distal end. The blade includes a base; an upper edge opposed to and spaced apart from the base; and, at least one cutting edge extending along at least a portion of the base. A portion of the blade extends into the distal end and another portion of the blade extends outwardly from the distal end of the neck. The utility knife also includes apparatus for pivotally attaching the proximate end to the first end such that the neck can be moved between two positions, a first open unfolded position with the cutting edge exposed for use to cut an object, and a second closed folded position with the cutting edge positioned adjacent the handle. The utility knife also includes anchor apparatus to releasably secure the blade in the neck.

In yet a further embodiment of the invention, I provide an improved method for cutting a piece of material. The method includes the step of providing a utility knife. The utility knife includes a handle having a first end and a second end; a neck having a distal end and having a proximate end; and, a trapezoidal blade mounted on the distal end. The blade includes a base; an upper edge opposed to and spaced apart from the base; a cutting edge extending along at least a portion of the base; and, apparatus for pivotally attaching the proximate end of the neck to the first end of the handle such that the neck can be moved between two positions, a first open unfolded position with the cutting edge exposed for use to cut an object, and a second closed folded position with the cutting edge positioned adjacent the handle. The neck is in the second position. The knife also includes apparatus to secure releasably the blade in the neck. The method also includes the steps of moving the neck to the first open unfolded position; and, cutting the material with the cutting edge of the trapezoidal blade.

In yet still another embodiment of the invention, I provide an improved method for providing a fresh edge for cutting a piece of material. The method includes the step of providing a utility knife. The utility knife includes a handle having a first end and a second end; a neck having a distal end, a proximate end, and a longitudinal axis; an aperture formed in the distal end of the neck; and, a trapezoidal blade slidably inserted in the aperture. The blade includes a base; an upper edge opposed to and spaced apart from the base, and at least one used cutting edge on said base. The blade is moveable between two positions with respect to the aperture, a first position with the blade slidably removed from the aperture in a direction of travel generally parallel to the longitudinal axis, and a second inserted position with a portion of the blade slidably inserted in the aperture in a direction of travel generally parallel to the longitudinal axis and with the blade generally parallel to said longitudinal axis. The utility knife also includes apparatus for attaching the proximate end to the first end such that the neck can be moved between two positions, a first open unfolded position with the cutting edge exposed for use to cut an object, and a second closed folded position with the cutting edge positioned adjacent the handle; and, securing apparatus for removably anchoring the blade in the second position in the aperture, the securing apparatus being positioned outside the handle when the neck is in the second position. The method also includes the steps of manipulating, while the neck is in the second closed folded position, the securing apparatus to release the blade such that the blade can be slidably removed from the aperture; slidably removing the blade from the aperture in a direction of travel generally parallel to the longitudinal axis; and, slidably inserting a blade with a fresh cutting edge in the aperture in a direction of travel generally parallel to the longitudinal axis.

In yet still a further embodiment of the invention, I provide an improved utility knife. The utility knife includes a handle having a first end and a second end; a neck having a distal end and a proximate end; and, a trapezoidal blade mounted on the distal end. The blade includes a base, an upper edge opposed to and spaced apart from the base, and at least one cutting edge extending along at least a portion of the base. A portion of the blade extends into the distal end and another portion of the blade extends outwardly from the distal end of the neck. The utility knife also includes apparatus for pivotally attaching the proximate end to the first end such that the neck can be moved between two operative positions, a first open unfolded position with the cutting edge exposed for use to cut an object, and a second closed folded position with the cutting edge positioned in the groove. The utility knife also includes anchor apparatus to releasably secure the blade in the neck; and, a spring displaceable to bear against a portion of the neck when the neck is in the first open position to maintain the neck in the first open position.

Figure 3:
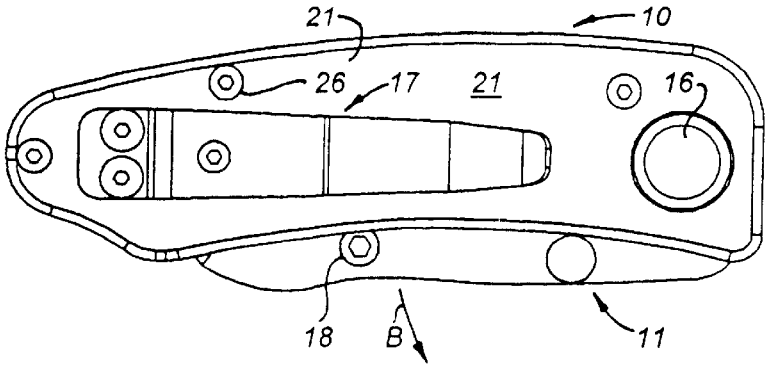
FIG. 3 is a side view of the utility knife of FIG. 2 illustrating further construction details thereof.
Figure 4:
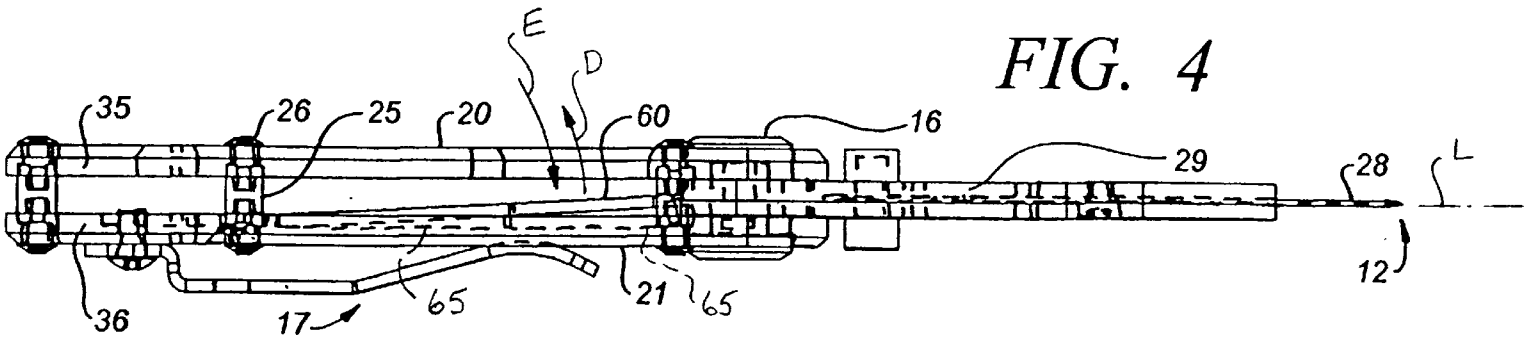
FIG. 4 is a top view of the utility knife of FIG. 1 illustrating the knife after it has been rotated about 180 degrees about axis X.
Figure 5:
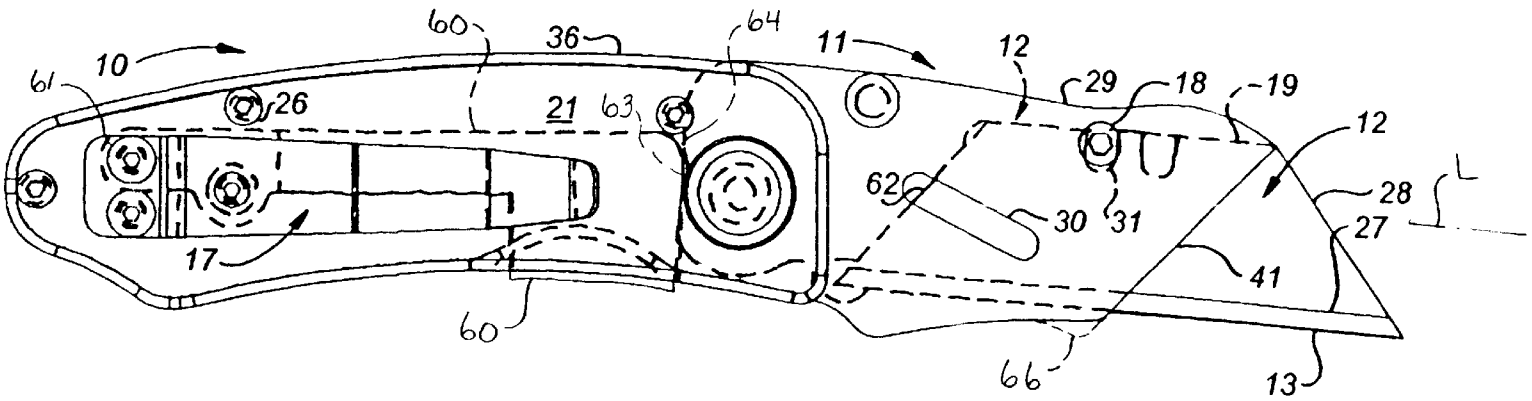
FIG. 5 is a side view of the utility knife of FIG. 4 illustrating additional construction details thereof.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 7 illustrate a utility knife including a handle 10 and neck 11. Handle 10 includes first end 50, second end 51, and groove 54. Neck 11 includes distal end 52, proximate end 53, side 22, tip or leading edge 38, and upper edge 29. Opening 15 is formed through neck 11, and in one embodiment, through side 22 of neck 11. Opposing, spaced apart, slots 14 (FIG. 1) and 30 (FIG. 5) can be used to assist in removing blade 12 from neck 11 in the direction of arrow Z. Blade 12 includes leading edge 28 and trailing edge 62. Neck 11 includes aperture 39 shaped and dimensioned to slidably receive trapezoidal blade 12 such that an anchor opening 31 formed in blade 12 moves into registration with opening 15. When openings 15, 30 are in registration, bolt/nut 18 is passed through openings 15, 30 to removably fixedly secure blade 13 in aperture 39 and, consequently, in neck 11. Aperture 39 is bounded on one side by edge 40 (FIG. 1) and on the other side by edge 41 (FIG. 5). A pin or other desired fastening means can be used in place of bolt/nut 18. By way of example, and not limitation, if blade 12 is about 0.038 inch wide, then aperture 39 is typically from 0.039 to 0.048 inch wide.

Trapezoidal blade 12 includes base 27 (FIG. 5), upper edge 19 (FIG. 5), and anchor opening 31. The shape and dimension of upper edge 19 can vary as desired. Cutting edge 13 extends along base 27. When blade 12 is mounted in neck 11 in the manner shown in FIGS. 1 to 7, about one-half of cutting edge 13 (i.e., 40% to 60% of the length of edge 13) extends outwardly away from aperture 39 and neck 11 and can be utilized to cut an object. The other half of edge 13 is housed in aperture 39 in neck 11 such that the other half of edge 13 cannot be utilized for cutting. The proportion of blade 12 housed in neck 11 and unavailable for cutting can vary as desired.

The proximate end 53 of neck 11 is pivotally attached to the first end 50 of handle 10 by pin apparatus 16 or by any other desired fastening apparatus which permits neck 11 to pivot with respect to handle 10. Vertically oriented axis extends through pin apparatus 16.

Handle 10 includes sides 20 and 21. Side 20 includes upper edge 35. Side 21 includes upper edge 36. Clip 17 (FIGS. 2 and 3) is attached to side 21. Clip 17 permits the utility knife of the invention to be secured to a shirt pocket, belt, etc. Sides 20 and 21 are secured together by a plurality of bolts which each pass through an aperture in side 20 or 21 and thread into internally threaded hollow spacers. For example, in FIGS. 1 to 3, externally threaded bolts 26 thread into hollow, internally threaded spacer 25.

In use, neck 11 is pivotally attached to handle 10 with pin apparatus 16. Bolt/nut 18 is removed from opening 15. Trapezoidal blade 12 is slidably inserted in aperture 39 in the direction of arrow Y in FIG. 1 until opening 15 is in registration with opening 31. Aperture 39 and blade 12 are preferably, but not necessarily, shaped and dimensioned such that when blade 12 seats in aperture 39, openings 15 and 31 are in alignment. Bolt/nut 18 is inserted through aligned openings 15, 31 to removably fixedly secure blade 12 in aperture 39 and neck 11. Neck 11 is pivoted in the direction of arrow A to the folded operative position illustrated in FIGS. 2, 3, 6, 7. In the folded operative position, edge 13 is housed in groove 54. Groove 54 extends between sides 20 and 21 of handle 10. Spring 60 functions in the manner of a spring found in conventional pocket knives and functions to maintain neck 11 either in the folded operative position of FIGS. 2 and 3 or in the open or deployed operative position of FIGS. 1, 4, and 5. Spring 60 has a fixed end 61 (FIG. 5) and a moveable end 63 (FIG. 5). Upon pivoting of neck 11 from the folded operative position to the opened operative position, spring end 63 and neck base edge 64 (FIGS. 5, 7) substantially align, allowing spring 60 to fully or partially deploy from a retracted position 65 (FIG. 4) in substantially direction D (FIG. 4). Applying pressure to spring 60 substantially in direction E (FIG. 4) returns spring 60 to the retracted position 65 (FIG. 4).

Figure 2:
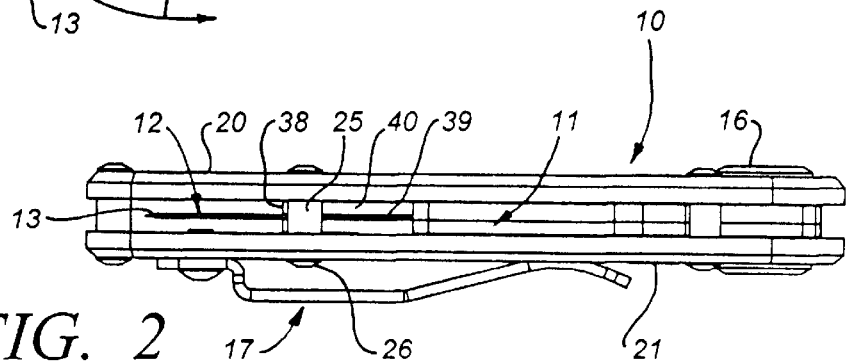
FIG. 2 is a bottom view of the utility knife of FIG. 1 illustrating the knife after the neck has been pivoted from the open position of FIG. 1 to a closed position.

After the utility knife is in the folded operative position of FIG. 2, it is transported to a desired location at which the portion of neck 11 extending outwardly from handle 10 in FIG. 3 is grasped between the fingers of one hand and pulled outwardly in the direction of arrow B and pulled to the open operative position illustrated in FIG. 1. The handle 10 is then grasped, and the utility knife can be manipulated such that edge 13 cuts a desired object. In the event it is desired to remove blade 12, nut/bolt assembly 18 is removed and the nose of a screwdriver or other object is inserted into slot(s) 14, 30 against edge 62 (FIG. 5) of blade 12. The nose of the screwdriver is pushed or pulled in the direction of arrow C along slot(s) 14, 40 to push blade 12 out of aperture 39. A new blade 12 is inserted in the manner earlier described, or, the old blade is turned 180 degrees to expose the unused portion of edge 13 and is reinserted in aperture 39. Assembly 18 can be positioned inside or outside of groove 54 when neck 11 is in the closed position of FIG. 3.

Figure 8:
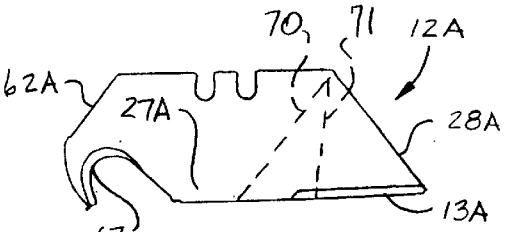
FIG. 8 is a front elevation view of another trapezoidal blade used in the utility knife of the invention.

FIG. 8 illustrates another trapezoidal blade 12A which can be utilized in the practice of the invention. Blade 12A includes base 27A, leading edge 28A, trailing edge 62A and cutting edges 13A and 67. Hook-shaped cutting edge 67 extends along a portion of base 27A. Straight cutting edge 13A extends along a portion of base 27A.

Figure 9:
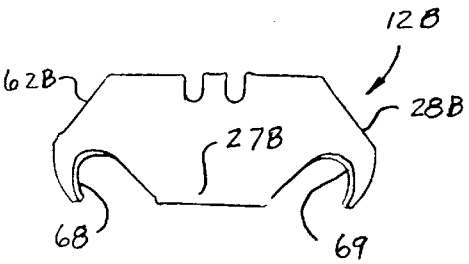
FIG. 9 is a front elevation view of another trapezoidal blade used in the utility knife of the invention.

FIG. 9 illustrates still another trapezoidal blade 12B that can be utilized in the practice of the invention. Blade 12B includes base 27B, leading edge 28B, trailing edge 62B and cutting edges 69 and 68. Hook-shaped cutting edge 68 extends along a portion of base 27B. Hook-shaped cutting edge 69 extends along a portion of base 27B. It is understood that the trapezoidal shape of a blade 12, 12A, 12B can vary as desired as long as the blade provide at least one cutting edge which can be utilized in the manner illustrated in FIGS. 1 to 9, 10. For example, if the triangular portion of blade 12A to the right of dashed line 70 in FIG. 8 is cut off blade 12A, the remaining portion of blade 12A still has a trapezoidal shape. Or, if the triangular portion of blade 12A to the right of dashed line 71 in FIG. 8 is cut off blade 12A, the remaining portion of blade 12A is deemed to have a trapezoidal shape.

Figure 10:
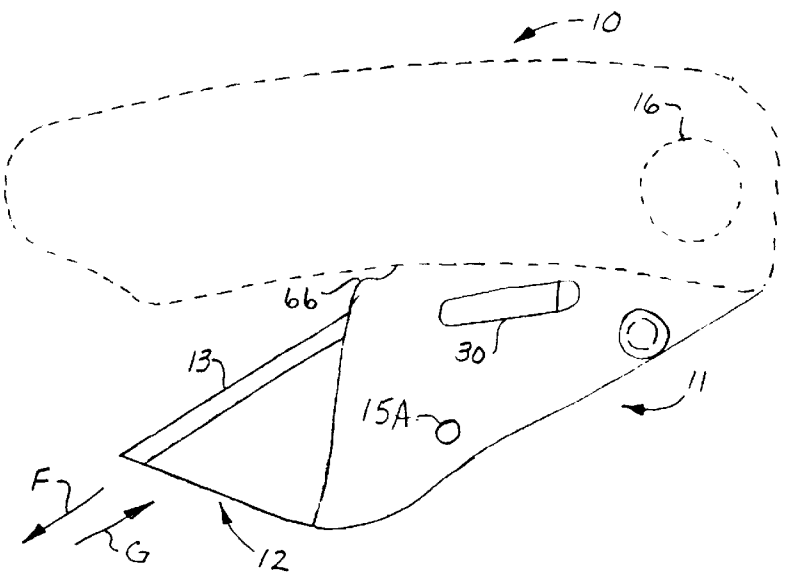
FIG. 10 is a front view illustrating the insertion in the utility knife of the invention a trapezoidal blade having a fresh cutting edge.

FIG. 10 illustrates how a blade 12 is removed from and inserted in the utility knife of the invention. When the utility knife is in the orientation illustrated in FIG. 3, an Allen wrench, pliers, or a user's fingers can be utilized to remove bolt 18. This is particularly advantageous because bolt 18 is positioned outside of handle 10 so that it can be removed without requiring neck 11 to be moved to an open position which would expose cutting edge 13. Bolt 18 extends through apertures 15 and 15A in neck 11 and through aperture 31 (FIG. 5) in blade 12. Once bolt 18 is removed, blade 12 is grasped and pulled outwardly in the direction of travel indicated by arrow F. The direction of travel indicated by arrow F is parallel to the longitudinal axis L (FIGS. 4, 5) of neck 11. Blade 12 normally is removed when it is damaged or when cutting edge 13 is dull.

Before blade 12 can be removed, neck 11 is slightly opened in the manner illustrated in FIG. 10 so that there is room to pull blade 12 free from neck 11 without blade 12 contacting handle 11. Neck 11 is slightly opened by pivoting neck 11 from the closed position shown in FIGS. 2, 3, 6, 7 through an angle of less than ninety degrees.

A replacement blade with a fresh cutting edge is obtained. A fresh cutting edge can be obtained by obtaining a brand new blade, or, in the event only half of the cutting edge 13 of blade 12 has been used, by rotating the blade 12 one hundred and eighty degrees to expose the unused portion of edge 13 that was housed inside neck 11 while the exposed portion of edge 13 of blade 12 was used.

Once a replacement blade with a fresh cutting edge 13 is obtained, it is slid into aperture 39 in the direction of travel indicated by arrow G to the position which was occupied by blade 12 before blade 12 was removed. The direction of travel indicated by arrow G is generally parallel to the longitudinal axis L of neck 11. A direction of travel is generally parallel to the longitudinal axis L if the angle between axis L and the direction of travel is ten degrees or less.

For sake of this example, it is assumed that the shape and dimension of the replacement blade is equal to that of blade 12. A replacement blade could, however, be some other trapezoidal blade, for instance, the blades in FIGS. 8 and 9.

After a replacement blade is slidably inserted in neck 11 to the position illustrated in FIG. 10, bolt 18 is installed through apertures 15, 15A and through aperture 31 of the replacement blade to releasably secure the replacement blade on neck 11.

The above-described procedure for replacing a blade 12 in neck 11 is particularly safe because cutting edge 13 is either housed in handle 11 or is close to handle 11 (as shown in FIG. 10) while blade 12 is being released and slidably pulled from neck 11.

Figure 11:
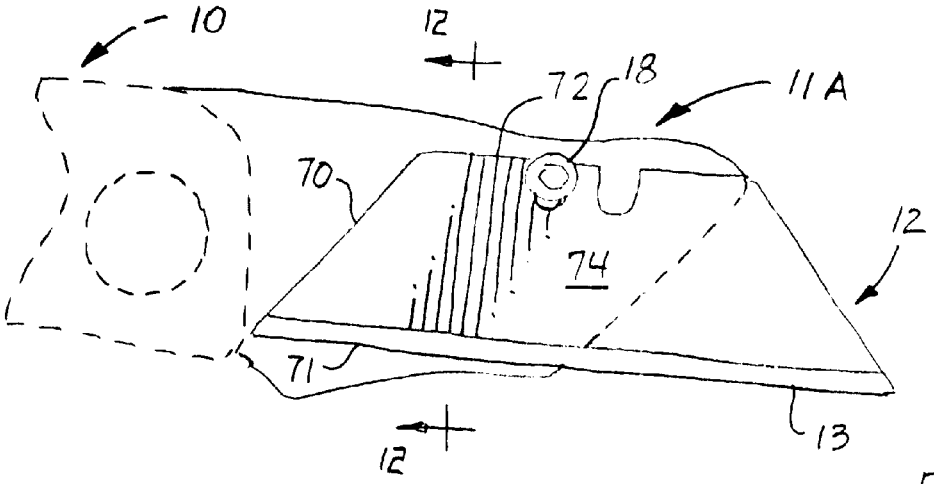
FIG. 11 is a front elevation view illustrating an alternate embodiment of the invention; and, FIG. 12 is a side sectional view of the utility knife of FIG. 11.
Figure 12:
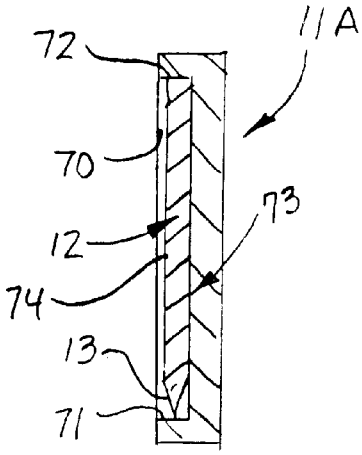

In FIGS. 1 to 7, 10, when a blade 12 is mounted on neck 11, the portion of blade 12 in aperture 39 is fully bounded on both sides by neck 11. If desired, however, blade 12 can be mounted on neck 11 such that blade 12 is not fully bounded on both sides by neck 11. For example, in FIGS. 11 and 12, neck 11A is configured such that blade 12 is only bounded on one side by neck 11A. A detent or aperture 73 is formed in neck 11A such that one side or face 74 of blade 12 is fully exposed. Detent 73 includes edges 72, 70, and 71 which bound and contact the portion of blade 12 mounted on neck 11A. Although blade 12 can be slid into detent 73, blade 12 can also be mounted on neck 11A by placing an end of blade 12 in registration with detent 73 and by then simply dropping or pushing that end of blade 12 into detent 73, after which a bolt 18 or other means is used to secure releasably blade 12 on neck 11A.

A finger stop 66 is formed on the bottom of neck 11 adjacent cutting edge 13 and blade 12. The finger stop helps to prevent a user from sliding his index finger along the bottom of neck 11 onto cutting edge 13.

Having described my invention in such terms as to enable those of skill in the art to make and practice it, and having described the presently preferred embodiments thereof,

I claim:

1. A utility knife including (a) a handle having a first end and a second end;

(b) a neck having
  (i) a distal end,
  (ii) a proximate end,
  (iii) a longitudinal axis, and (c) an aperture formed in said distal end of said neck;

(d) a substantially planar trapezoidal blade slidably inserted in said aperture, said blade including
  (i) a base,
  (ii) an upper edge opposed to and spaced apart from said base,
  (iii) at least one cutting edge extending along at least a portion of said base, wherein said blade further includes an anchor opening in said blade to facilitate retaining the blade in a blade holder, and said blade moveable between two positions with respect to said aperture, (iv) a first position with said blade slidably removed from said aperture, and (v) a second inserted position with a portion of said blade slidably inserted in said aperture and with said blade generally parallel to said longitudinal axis;

(e) means for attaching said proximate end to said first end; and (f) means for releasably securing said blade in said second position in said aperture.

2. A utility knife including:

a handle configured to pivotally mate with a neck; and, a removable, replaceable, substantially planar blade adapted to mate with the neck, said neck including a blade retainer, wherein the blade includes an anchor opening which is in operative position with an opening in the neck, and the blade retainer includes a bolt, such that the bolt extends through the neck opening and the anchor opening.

3. A utility knife including (a) a handle having a first end and a second end;

(b) a neck having a distal end and a proximate end;

(c) a trapezoidal blade mounted on said distal end, said blade including (i) a base, (ii) an upper edge opposed to and spaced apart from said base, and (iii) at least one cutting edge extending along at least a portion of said base;

a portion of said blade extending into said distal end and another portion of said blade extending outwardly from said distal end of said neck;

(d) means for pivotally attaching said proximate end to said first end such that said neck can be moved between two positions, (i) a first open unfolded position with said cutting edge exposed for use to cut an object, and (ii) a second closed folded position with said cuffing edge positioned adjacent said handle;

(e) anchor means to releasably secure said blade in said neck; and, (f) a spring displaceable to bear against a portion of said neck when said neck is in said first open position to maintain said neck in said first open position.

4. A utility knife including (a) a handle having a first end, a second end, and a clip;

(b) a neck having a distal end and having a proximate end;

(c) a trapezoidal blade mounted on said distal end, said blade including (i) a base, (ii) an upper edge opposed to and spaced apart from said base, and (iii) at least one cutting edge extending along at least a portion of said base;

a portion of said blade extending into said distal end and another portion of said blade extending outwardly from said distal end of said neck;

(d) means for pivotally attaching said proximate end to said first end such that said neck can be moved between two positions, (i) a first open unfolded position with said cutting edge exposed for use to cut an object, and (ii) a second closed folded position with said cuffing edge positioned adjacent said handle; and, (e) anchor means to releasably secure said blade in said neck.

5. A utility knife including (a) a handle having a first end and a second end;

(b) a neck having a distal end, a proximate end, a top, and a bottom;

(c) a trapezoidal blade mounted on said distal end, said blade including (i) a base, (ii) an upper edge opposed to and spaced apart from said base, and (iii) at least one cutting edge extending along at least a portion of said base;

a portion of said blade extending into said distal end and another portion of said blade extending outwardly from said distal end of said neck;

(d) means for pivotally attaching said proximate end to said first end such that said neck can be moved between two positions, (i) a first open unfolded position with said cutting edge exposed for use to cut an object, and (ii) a second closed folded position with said cutting edge positioned adjacent said handle;

(e) anchor means to releasably secure said blade in said neck; and, (f) a finger stop on said bottom adjacent said blade.

6. A utility knife including (a) a handle having a first end and a second end;

(b) a neck having a distal end and having a proximate end;

(c) a trapezoidal blade mounted on said distal end, said blade including (i) a base, (ii) an upper edge opposed to and spaced apart from said base, and (iii) at least one cuffing edge extending along at least a portion of said base;

a portion of said blade extending into said distal end and another portion of said blade extending outwardly from said distal end of said neck;

(d) means for pivotally attaching said proximate end to said first end such that said neck can be moved between two positions, (i) a first open unfolded position with said cutting edge exposed for use to cut an object, and (ii) a second closed folded position with said cutting edge positioned adjacent said handle; and, (e) anchor means to releasably secure said blade in said neck.

7. The utility knife of claim 6, wherein said anchor means to releasably secure said blade in said neck includes a securing pin.

8. A method for culling a piece of material, comprising the steps of:

(a) providing a utility knife including (i) a handle having a first end and a second end, (ii) a neck having a distal end and having a proximate end, (iii) a substantially planar trapezoidal blade mounted on the distal end, the blade including a base, an upper edge opposed to and spaced apart from said base, and at least one cutting edge extending along at least a portion of said base, (iv) means for pivotally attaching the proximate end of the neck to the first end of the handle such that the neck can be moved between two positions, a first open unfolded position with said cutting edge exposed for use to cut an object, and a second closed folded position with said cutting edge positioned adjacent said handle, said neck being in said second position; and, (v) securing means utilizing an anchor opening in said blade to facilitate releasably retaining said blade in said neck;

(b) moving said neck to said first open unfolded position; and, (c) culling said material with said cutting edge of said trapezoidal blade.

9. A method for providing a fresh edge for culling a piece of material, comprising the steps of (a) providing a utility knife including (i) a handle having a first end and a second end;

(ii) a neck having a distal end, and a proximate end, and a longitudinal axis, (iii) an aperture formed in said distal end of said neck;

(iv) a substantially planar trapezoidal blade slidably inserted in said aperture, said blade including a base, an upper edge opposed to and spaced apart from said base, and at least one used cutting edge on said base, and said blade moveable between two positions with respect to said aperture, a first position with said blade slidably removed from said aperture in a direction of travel generally parallel to said longitudinal axis, and a second inserted position with a portion of said blade slidably inserted in said aperture in a direction of travel generally parallel to said longitudinal axis and with said blade generally parallel to said longitudinal axis;

(v) means for attaching said proximate end to said first end such that said neck can be moved between two positions, a first open unfolded position with the cuffing edge exposed for use to cut an object, and a second closed folded position with said culling edge positioned adjacent said handle, and, (vi) securing means utilizing an anchor opening in said blade to facilitate releasably retaining said blade in said second inserted position in said aperture, said securing means being positioned outside said handle when said neck is in said second closed folded position;

(b) manipulating, while said neck is in said second closed folded position, said securing means to release said blade such that said blade can be slidably removed from said aperture;

(c) slidably removing said blade from said aperture in a direction of travel generally parallel to said longitudinal axis;

(d) slidably inserting a blade with a fresh cutting edge in said aperture in a direction of travel generally parallel to said longitudinal axis.

* * * * *

UNITED STATES PATENT AND TRADEMARK OFFICE

CERTIFICATE OF CORRECTION

PATENT NO. : 6,688,003 B2
DATED : February 10, 2004
INVENTOR(S) : Scaria, Robert E.

It is certified that error appears in the above-identified patent and that said Letters Patent is hereby corrected as shown below:

Column 10,
Line 52, change “culling” to -- cutting --.

Column 11,
Lines 11 and 13, change “culling” to -- cutting --.

Signed and Sealed this

Twenty-first Day of December, 2004

JON W. DUDAS
*Director of the United States Patent and Trademark Office*